US009289821B2

(12) United States Patent
Lee et al.

(10) Patent No.: US 9,289,821 B2
(45) Date of Patent: Mar. 22, 2016

(54) APPARATUS FOR PREVENTING DAMAGE TO CASTING ROLLS IN STRIP CASTING MACHINE

(71) Applicant: POSCO, Pohang-si (KR)

(72) Inventors: Dae-Sung Lee, Pohang-si (KR); Seong-In Jeong, Pohang-si (KR); Sang-Hoon Kim, Pohang-si (KR); Man-Jin Ha, Pohang-si (KR); Ji-Woo Im, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 14/574,673

(22) Filed: Dec. 18, 2014

(65) Prior Publication Data

US 2015/0174651 A1 Jun. 25, 2015

(30) Foreign Application Priority Data

Dec. 24, 2013 (KR) ..... 10-2013-0162696
Aug. 22, 2014 (KR) ..... 10-2014-0109908

(51) Int. Cl.
*B22D 11/16* (2006.01)
*B22D 11/06* (2006.01)

(52) U.S. Cl.
CPC ..... *B22D 11/168* (2013.01); *B22D 11/0622* (2013.01)

(58) Field of Classification Search
CPC ..... B22D 11/0622; B22D 11/168
USPC ..... 164/428, 436, 451, 452, 480, 491
See application file for complete search history.

(56) References Cited

U.S. PATENT DOCUMENTS 6,408,222 B1 * 6/2002 Kim ..... B22D 11/16 164/452
6,820,680 B1 * 11/2004 Fukase ..... B22D 11/0622 164/480
8,684,068 B2 * 4/2014 Kweon ..... B22D 11/066 164/154.5
2006/0037732 A1 2/2006 Kim et al.
2007/0034349 A1 * 2/2007 Savariego ..... B22D 11/20 164/480

FOREIGN PATENT DOCUMENTS

JP 58176062 A 10/1983
JP 603951 A 1/1985
JP 63303655 A 12/1988
JP 63171258 A 7/1998
JP 2005-111522 4/2005
JP 2006511350 A 4/2006
KR 10-1999-0054414 A 7/1999
KR 19990051963 A 7/1999
KR 10-2001-0057450 A 7/2001

(Continued)

*Primary Examiner* — Kevin E Yoon
(74) *Attorney, Agent, or Firm* — The Webb Law Firm

(57) ABSTRACT

The apparatus for preventing damage to casting rolls includes: a roll pressing force detection unit measuring a roll pressing force applied to the casting rolls; a foreign object determination unit determining whether foreign objects have been introduced to the casting rolls based on the measured roll pressing force; a roll gap instruction value generation unit generating a roll gap instruction value by adding a preset roll gap amount to the set roll gap if it is determined that foreign objects have been introduced to the casting rolls; and a roll gap control unit controlling a roll gap between the casting rolls based on the roll gap instruction value. Therefore, surfaces of the casting rolls may be less damaged by foreign objects.

11 Claims, 7 Drawing Sheets

(56) References Cited

FOREIGN PATENT DOCUMENTS

| | | | |
|---|---|---|---|
| KR | 10-2005-0065061 | A | 6/2005 |
| KR | 10-779571 | B1 | 11/2007 |
| KR | 100815738 | B1 | 3/2008 |
| KR | 10-2011-0069598 | A | 6/2011 |
| KR | 1020110069604 | A | 6/2011 |
| WO | 2009115877 | A1 | 9/2009 |

* cited by examiner

APPARATUS FOR PREVENTING DAMAGE TO CASTING ROLLS IN STRIP CASTING MACHINE

CROSS-REFERENCE TO RELATED APPLICATIONS

This application claims the priority and benefit of Korean Patent Application Nos. 10-2013-0162696 filed on Dec. 24, 2013 and 10-2014-0109908 filed on Aug. 22, 2014, with the Korean Intellectual Property Office, the disclosures of which are incorporated herein by reference.

FIELD OF THE INVENTION

The present disclosure relates to an apparatus for preventing casting rolls of a strip casting machine from being damaged by foreign objects.

BACKGROUND OF THE INVENTION

Strip casting is a new steel forming process by which strips can be directly produced from molten steel without the need to perform a hot rolling process for markedly reducing manufacturing costs, equipment investment, energy consumption, pollutant emission, and so on.

Particularly, in a twin roll strip casting process in which molten steel is supplied to an upper region of casting rolls (the surface of molten steel is termed "a molten steel surface"), the surfaces of the casting rolls are frequently damaged by skulls or foreign substances growing on the molten steel surface, refractory material particles generating from edge dams, skulls growing on lateral sides of the casting rolls, and so on.

If casting rolls are damaged as described above, the quality of strips is directly affected, and thus it is necessary to protect the surfaces of the casting rolls from foreign objects. For example, a technique for protecting casting rolls from foreign objects is disclosed in Korean Patent Application Laid-open Publication No.: 2005-0065061 (entitled "Method for protecting the casting rolls from the entrapment of foreign object in the twin roll strip casting machine," and published on Jun. 29, 2005).

However, in the Korean patent application (2005-0065061), if foreign objects are attached to casting rolls while a roll gap is controlled in a position control mode, the operation mode is changed from the position control mode to a pressing force control mode so as to control the pressing force of the casting rolls, and after the foreign objects are removed, the operation mode is changed back to the position control mode. However, due to a delay caused by switching between the two modes, it may take a considerable period of time to remove foreign objects, and thus process yields may be decreased.

In the above-described twin roll strip casting process, a solidified strip is drawn out by inserting a leader strip between the (two) casting rolls and drawing the leader strip out from the carting rolls after molten steel is attached to the leader strip. At this time, casting roll cylinders are used to drive the casting rolls at high pressure (for example, by applying a force of about 20 tons) in an early stage of the casting process, to thus stably attach molten steel to the leader strip. In addition, the two casting rolls are controlled for maintaining a uniform gap (roll gap) between the two casting rolls, stabilizing sealing at edge dams, and easily drawing out strips.

However, values output from a roll gap sensor used to measure the gap (roll gap) between the two casting rolls are largely varied with time, and thus if the gap (roll gap) between the two casting rolls is controlled based on the time-varying values, sealing by the edge dams may become unstable. Particularly, if foreign objects such as molten steel skulls are introduced between the two casting rolls, the surfaces of the two casting rolls may be damaged.

For example, a technique related thereto is disclosed in Korean Patent Application Laid-open Publication No.: 2011-0069598 (entitled "an apparatus and method for controlling wedge of strip in twin roll strip casting process," and published on Jun. 23, 2011).

RELATED ART DOCUMENTS (Patent Document 1) Korean Patent Application Laid-open Publication No.: 2005-0065061 entitled "Method for protecting the casting rolls from the entrapment of foreign object in the twin roll strip casting machine," and published on Jun. 29, 2005.

(Patent Document 2) Korean Patent Application Laid-open Publication No.: 2011-0069598 entitled "an apparatus and method for controlling wedge of strip in twin roll strip casting process," and published on Jun. 23, 2011.

SUMMARY OF THE INVENTION

An aspect of the present disclosure may provide an apparatus and method for preventing damage to casting rolls by removing foreign objects only via a roll gap control operation without a roll pressing force control operation so as to decrease damage to surfaces of the casting rolls and increase process yields by shortening a period of time necessary for removing foreign objects.

An aspect of the present disclosure may also provide an apparatus for preventing damage to casting rolls so as to stably attach molten steel to a leader strip in an early stage of casting, stabilize sealing by edge dams, and reduce damage to surfaces of the casting rolls caused by foreign objects.

According to an aspect of the present disclosure, there is provided an apparatus for preventing damage to casting rolls in a strip casting process in which the casting rolls are driven according to a target pressure value for maintaining a set roll gap. The apparatus may include: a roll pressing force detection unit measuring a roll pressing force applied to the casting rolls; a foreign object determination unit determining whether foreign objects have been introduced to the casting rolls based on the measured roll pressing force; a roll gap instruction value generation unit generating a roll gap instruction value by adding a preset roll gap amount to the set roll gap if it is determined that foreign objects have been introduced to the casting rolls; and a roll gap control unit controlling a roll gap between the casting rolls based on the roll gap instruction value.

The roll gap control unit may control the roll gap between the casting rolls based on the roll gap instruction value for a preset period of time, and after the preset period of time, the roll gap control unit may control the roll gap between the casting rolls based the set roll gap.

The preset roll gap amount may be proportional to the measured roll pressing force.

The preset period of time may be several seconds or shorter.

The apparatus may further include: a roll gap detection unit measuring a roll gap between a driving roll and a fixed roll constituting the casting rolls; a roll gap deviation calculation unit calculating a roll gap deviation along axes of the driving roll and the fixed roll based on the measured roll gap; a low pass filter unit through which the roll gap deviation is low-pass-filtered; and a pair of casting roll cylinders controlling the roll gap deviation according to a new target pressure value obtained by adjusting the target pressure value using the low-pass-filtered roll gap deviation.

The pair of casting roll cylinders may include: a first casting roll cylinder disposed on one side of the axis of the driving roll so as to drive the driving roll; and a second cast roll cylinder disposed on the other side of the axis of the driving roll so as to drive the driving roll.

A target pressure value may be increased for a casting roll cylinder disposed on one side of the axis of the driving roll to which foreign objects are introduced, and a target pressure value may be decreased for a casting roll cylinder disposed on one side of the axis of the driving roll to which foreign objects are not introduced.

One of the pair of casting roll cylinders may drive the driving roll according to a new target pressure value obtained by adding a value based on the low-pass-filtered roll gap deviation to the target pressure value, and the other of the pair of casting roll cylinders may drive the driving roll according to a new target pressure value obtained by subtracting a value based on the low-pass-filtered roll gap deviation from the target pressure value.

The value based on the low-pass-filtered roll gap deviation may be a value obtained by multiplying the low-pass-filtered roll gap deviation by a constant.

The roll gap deviation may be a value obtained by subtracting a roll gap between the driving roll and the fixed roll measured on the side on which the second casting roll cylinder is disposed from a roll gap between the driving roll and the fixed roll measured on the side on which the first casting roll cylinder is disposed.

The pair of casting roll cylinders may start to operate when molten steel solidified on a leader strip is drawn out between the casting rolls.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION OF THE INVENTION

Figure 1:
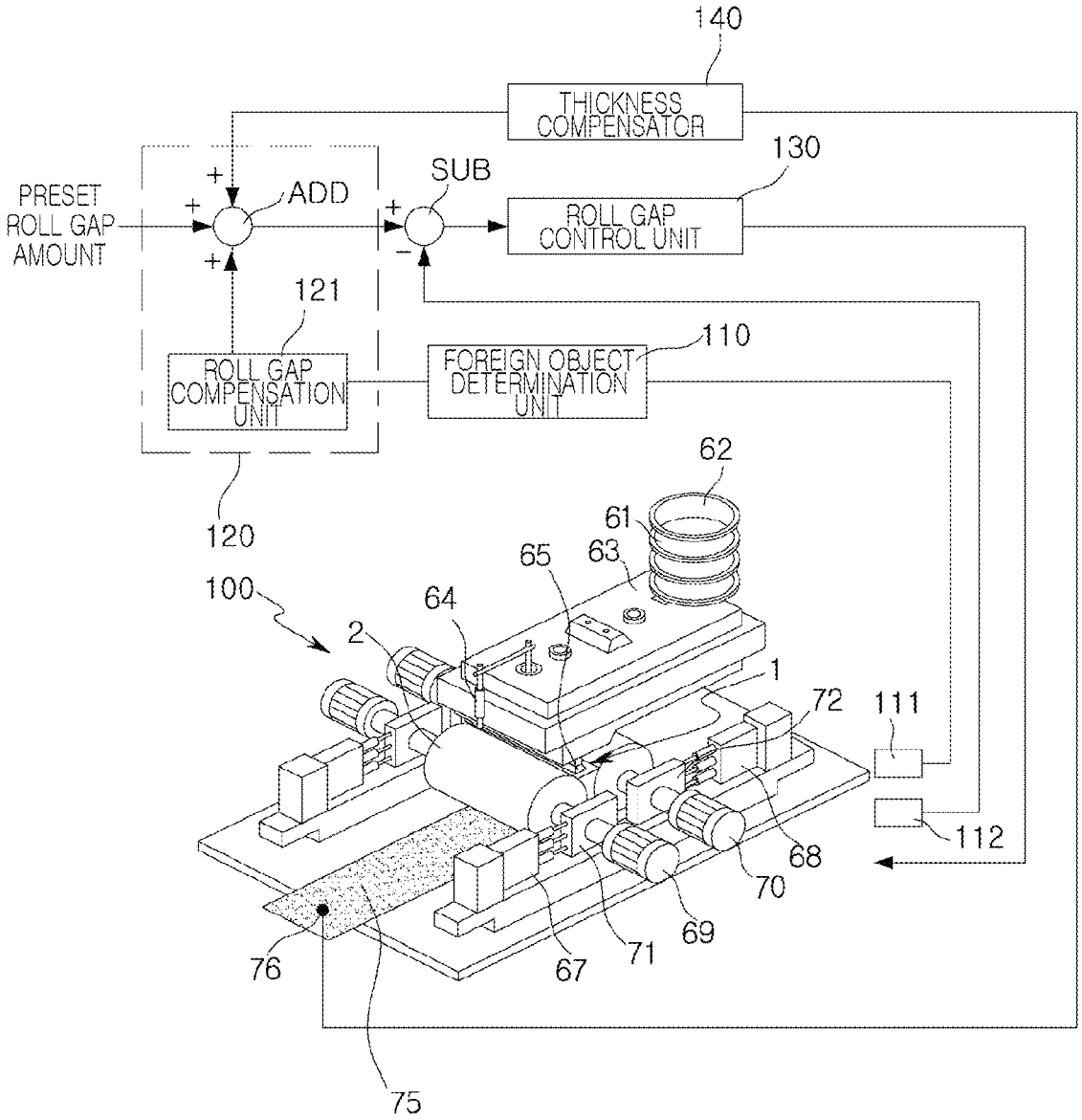
FIG. 1 is a view illustrating the entire structure of an apparatus for preventing damage to casting rolls in a twin roll strip casting machine according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a view illustrating the entire structure of an apparatus for preventing damage to casting rolls in a twin roll strip casting machine 100 according to an exemplary embodiment of the present disclosure. The casting roll damage preventing apparatus may include a roll pressing force detection unit 111, a roll gap detection unit 112, a foreign object determination unit 110, a roll gap instruction value generation unit 120, a subtracter SUB, a roll gap control unit 130, and a thickness compensator 140.

The twin roll strip casting machine 100 will now be briefly described with reference to FIG. 1. Molten steel 62 produced through a smelting process in a furnace is supplied to a ladle 61, and then a tundish 63, a temporary storage receptacle, receives the molten steel 62. Thereafter, the molten steel 62 is supplied from the turndish 63 to a sump formed between a casting roll 1 (a fixed roll) and a casting roll 2 (a driving roll) through a nozzle 65 and a molten steel control device 64.

Driving roll chucks 71 and fixed roll chucks 72 are installed on the pair of casting rolls (the fixed and driving rolls) 1 and 2 so that the pair of casting rolls 1 and 2 may be driven to undergo translational motion by the operation of driving roll cylinders 67 (corresponding to reference numerals 32 and 34 in FIG. 5) and fixed roll cylinders 68. In addition, the casting rolls 1 and 2 are connected to the driving roll chucks 71 and the fixed roll chucks 72 using bearings so that the casting rolls 1 and 2 may be rotated by driving roll motors 69 and fixed roll motors 70. In addition, a thickness sensor 76 is installed to check whether a strip 75 having a target thickness is produced.

Figure 2:
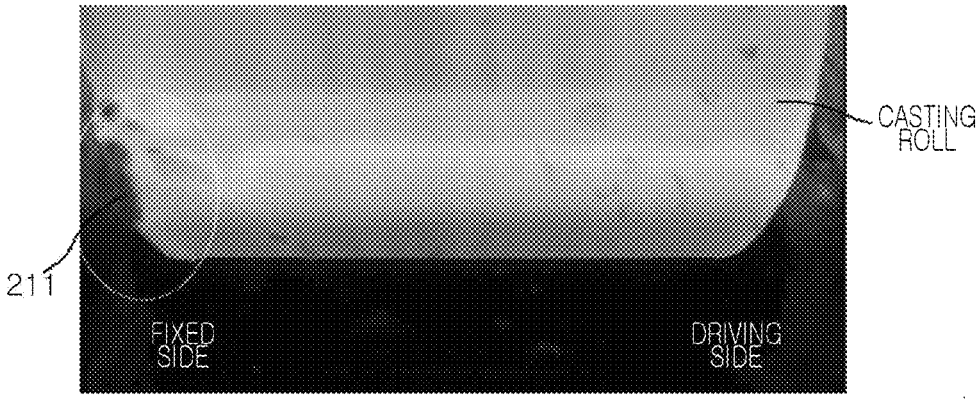
FIG. 2 is an image illustrating foreign objects attached to a casting roll.
Figure 3:
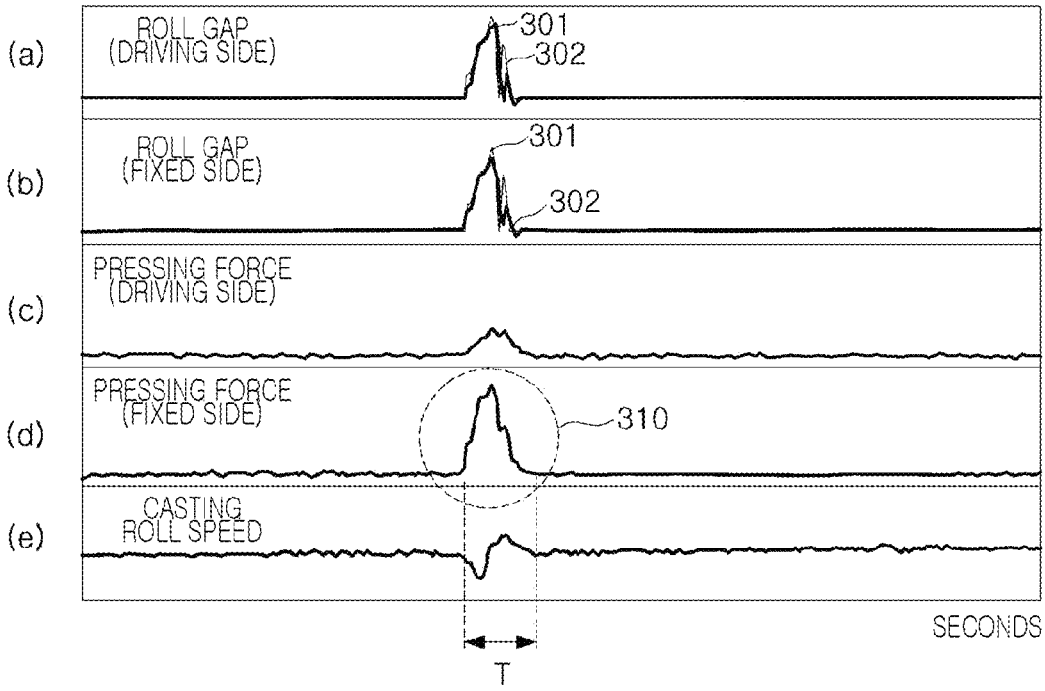
FIG. 3 is a graph illustrating roll gaps, pressing forces, a casting roll speed in the operation of the apparatus for preventing damage to casting rolls of the exemplary embodiment of the present disclosure.

FIG. 2 is an image illustrating foreign objects attached to one of the casting rolls 1 and 2, and FIG. 3 is a graph illustrating roll gaps, pressing forces, a casting roll speed in the operation of the casting roll damage preventing apparatus of the exemplary embodiment of the present disclosure.

Hereinafter, the casting roll damage preventing apparatus will be described in detail with reference to FIGS. 1 to 3 according to the exemplary embodiment of the present disclosure.

When the roll gap between the casting rolls 1 and 2 is controlled according to a set roll gap, the roll pressing force detection unit 111 may measure a roll pressing force applied to the casting rolls 1 and 2. Information regarding the measured roll pressing force may be delivered to the foreign object determination unit 110.

Based on the magnitude of the measured roll pressing force, the foreign object determination unit 110 may determine whether foreign objects are introduced between the casting rolls 1 and 2. That is, if foreign objects (please see reference numeral 211 in FIG. 2) are introduced between the casting rolls 1 and 2, a roll pressing force 310 is suddenly increased as shown in region (d) of FIG. 3. Therefore, the foreign object determination unit 110 may determine whether foreign objects are introduced between the casting rolls 1 and 2 based on the magnitude of the measured roll pressing force. Information regarding results about the determination and the measured roll pressing force may be delivered to the roll gap instruction value generation unit 120.

If it is determined that foreign objects are introduced between the casting rolls 1 and 2, the roll gap instruction value generation unit 120 may generate a new roll gap instruction value by adding a preset roll gap amount to the set roll gap.

In detail, a roll gap compensation unit 121 of the roll gap instruction value generation unit 120 may deliver a present roll gap amount proportional to the measured roll pressing force to an adder ADD of the roll gap instruction value generation unit 120, and then the adder ADD may generate a roll gap instruction value by adding the preset roll gap amount received from the roll gap compensation unit 121 to the set roll gap. The roll gap instruction value may be delivered to the subtracter SUB. Here, the preset roll gap amount may be a value proportional to the measured roll pressing force or a value obtained by multiplying the measured roll pressing force by a constant.

In the exemplary embodiment of the present disclosure, a strip thickness measured by the thickness sensor 76 may be delivered to the thickness compensator 140, and the thickness compensator 140 may generate a roll gap compensation value for maintaining a target thickness based on the measured strip thickness. Then, the adder ADD may add the roll gap compensation value to the roll gap instruction value to generate a new roll gap instruction value.

In addition, the subtracter SUB may calculate a roll gap error between the roll gap instruction value received from the roll gap instruction value generation unit 120 and a roll gap measured by the roll gap detection unit 112, and may deliver the calculated roll gap error to the roll gap control unit 130.

Finally, the roll gap control unit 130 may control the roll gap between the casting rolls 1 and 2 based on the roll gap error delivered from the subtracter SUB such that the roll gap between the casting rolls 1 and 2 may approach the roll gap instruction value delivered from the roll gap instruction value generation unit 120 (that is, so as to reduce the roll gap error to zero).

FIG. 3 is a view illustrating roll gaps, pressing forces, a casting roll speed in the operation of the casting roll damage preventing apparatus of the exemplary embodiment of the present disclosure. In FIG. 3, region (a) illustrates a driving-side casting roll gap with respect to time, region (b) illustrates a fixed-side casting roll gap with respect to time, region (c) illustrates a driving-side casting roll pressing force with respect to time, region (d) illustrates a fixed-side casting roll pressing force with respect to time, and region (e) illustrates a casting roll rotation speed with respect to time.

Referring to FIG. 3, when a casting roll gap control operation is performed according to a set roll gap instruction value, if foreign objects have been introduced to a fixed-side casting roll, the fixed-side casting roll pressing force is suddenly increased (please see a curve 310 in region (d)). Then, as shown in FIG. 3, the driving-side casting roll gap (please see a curve 302 in region (a)) and the fixed-side casting roll gap (please see a curve 302 in region (b)) are properly controlled according to new roll gap instruction values 301 so as to remove the foreign objects.

In this case, the roll gap control unit 130 may perform a foreign object removing roll gap control operation for a preset period of time T, for example, within several seconds, and after the preset period of time T, the roll gap control unit 130 may perform a casting roll gap control operation according to a set roll gap instruction value. That is, although a foreign object removing roll gap control operation is performed for only several seconds, foreign objects may be sufficiently removed.

Figure 4:
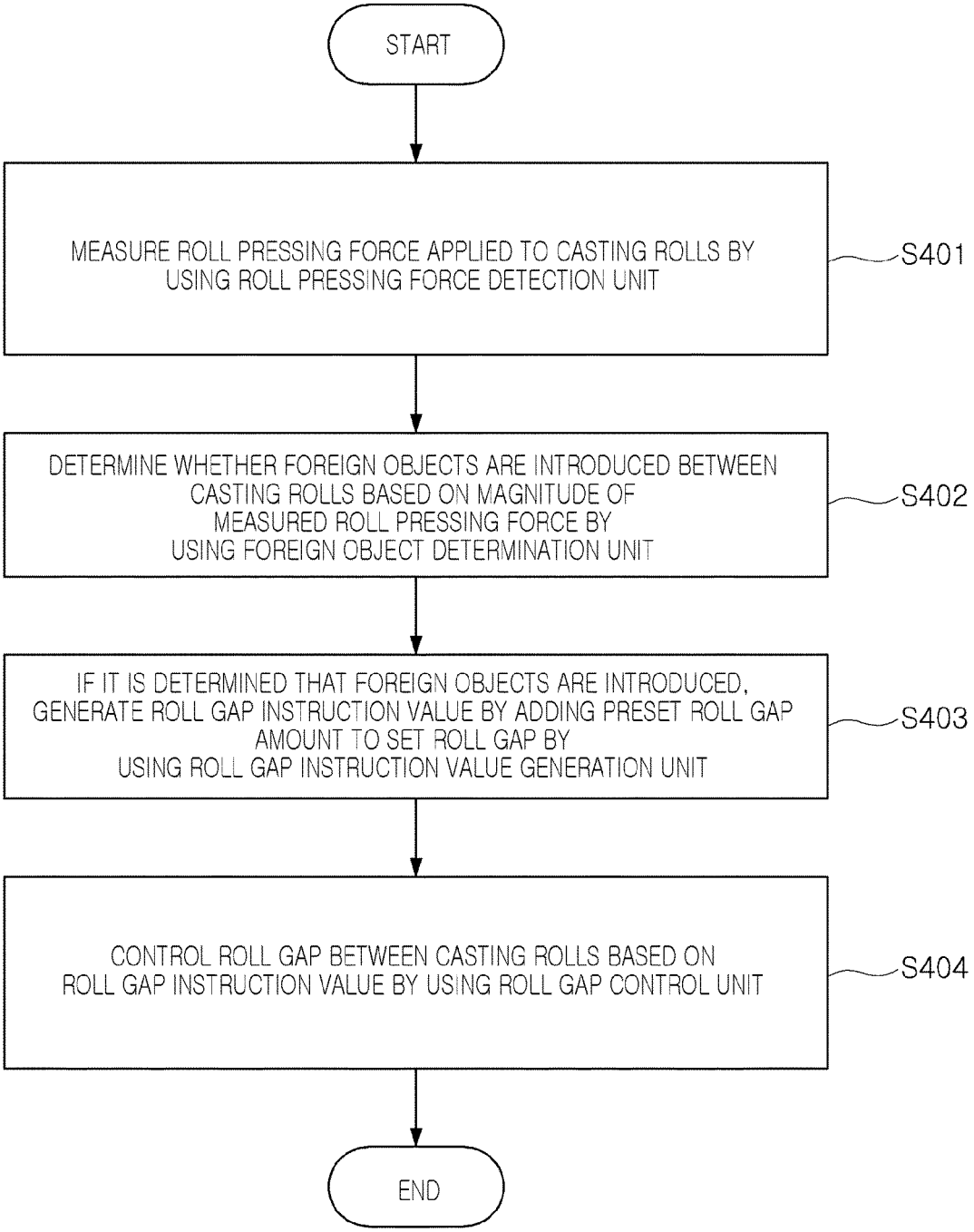
FIG. 4 is a flowchart illustrating a method for preventing damage to casting rolls in a twin roll strip casting machine according to the exemplary embodiment of the present disclosure.

FIG. 4 is a flowchart illustrating a method for preventing damage to casting rolls the exemplary embodiment of the present disclosure.

Hereinafter, a method for preventing damage to casting rolls will be described in detail with reference to FIGS. 1 to 4 according to the exemplary embodiment of the present disclosure. However, the same descriptions as those given above with reference to FIGS. 1 to 3 will not be repeated here for clarity.

Referring to FIGS. 1 to 4, first, when the roll gap between the casting rolls 1 and 2 is controlled according to a set roll gap, the roll pressing force detection unit 111 may measure a roll pressing force applied to the casting rolls 1 and 2 (S401). Information regarding the measured roll pressing force may be delivered to the foreign object determination unit 110.

Next, based on the magnitude of the measured roll pressing force, the foreign object determination unit 110 may determine whether foreign objects are introduced between the casting rolls 1 and 2 (S402). That is, if foreign objects are introduced between the casting rolls 1 and 2, a roll pressing force 310 is suddenly increased as shown in region (d) of FIG. 3. Therefore, the foreign object determination unit 110 may determine whether foreign objects are introduced between the casting rolls 1 and 2 based on the magnitude of the measured roll pressing force. Information regarding results about the determination and the measured roll pressing force may be delivered to the roll gap instruction value generation unit 120.

Next, if it is determined that foreign objects are introduced between the casting rolls 1 and 2, the roll gap instruction value generation unit 120 may generate a new roll gap instruction value by adding a preset roll gap amount to the set roll gap (S403).

In detail, the roll gap compensation unit 121 of the roll gap instruction value generation unit 120 may deliver a present roll gap amount proportional to the measured roll pressing force to the adder ADD of the roll gap instruction value generation unit 120, and then the adder ADD may generate a new roll gap instruction value by adding the preset roll gap amount received from the roll gap compensation unit 121 to the set roll gap. The roll gap instruction value may be delivered to the subtracter SUB. Here, the preset roll gap amount may be a value proportional to the measured roll pressing force.

Finally, the roll gap control unit 130 may control the roll gap between the casting rolls 1 and 2 based on the roll gap instruction value (S404).

Figure 5:
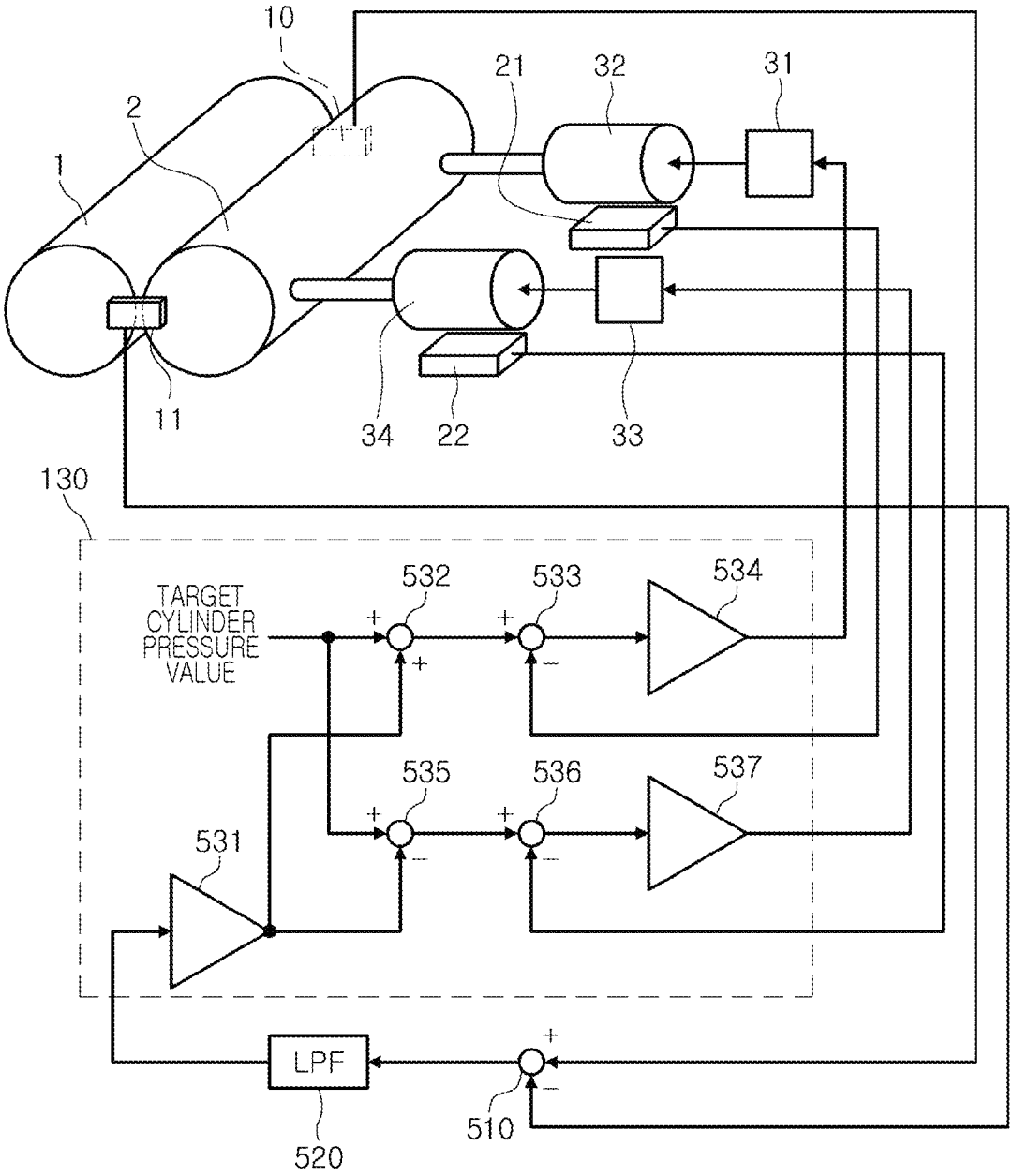
FIG. 5 is a view illustrating the structure of an apparatus for preventing damage to casting rolls in a twin roll strip casting process according to another exemplary embodiment of the present disclosure.
Figure 6:
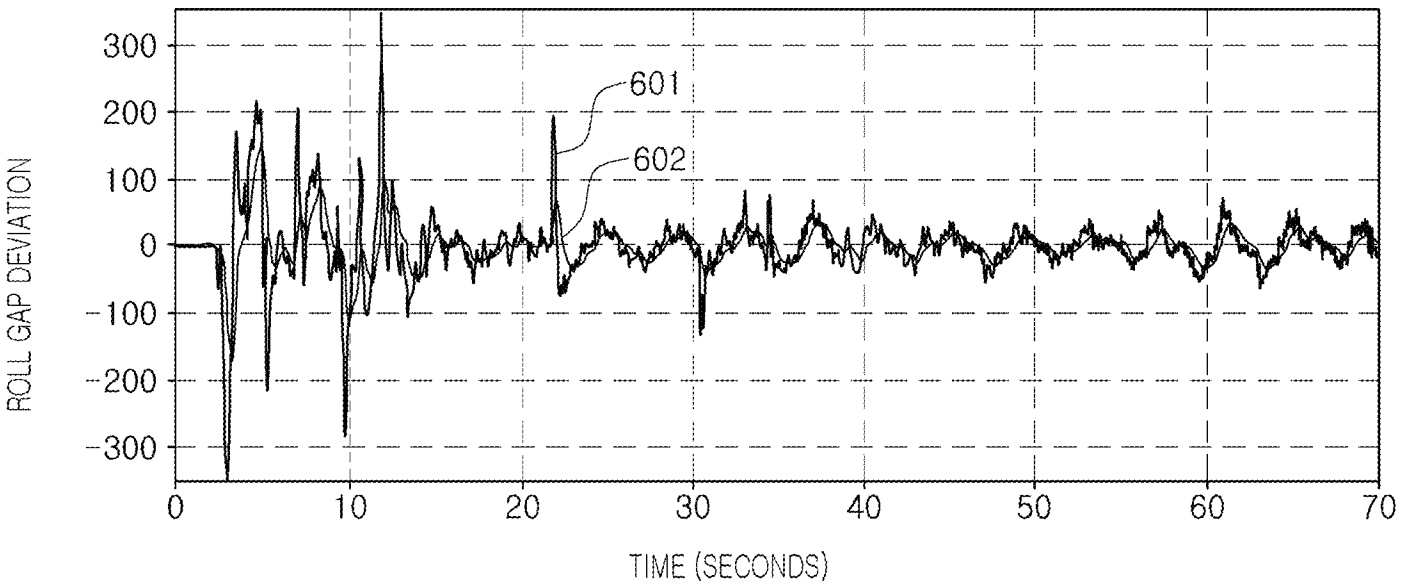
FIG. 6 is a graph illustrating a measured roll gap deviation and a low-pass-filtered roll gap deviation with respect to time according to the other exemplary embodiment of the present disclosure.

FIG. 5 is a view illustrating the structure of an apparatus for preventing damage to casting rolls in a twin roll strip casting process to another exemplary embodiment of the present disclosure. FIG. 6 is a graph illustrating a measured roll gap deviation and a low-pass-filtered roll gap deviation with respect to time according to the other exemplary embodiment of the present disclosure, and FIGS. 7A to 7F are views illustrating points in time for starting operation of a pair of first and second casting roll cylinders 32 and 34 in a twin roll strip casting process according to the other exemplary embodiment of the present disclosure. FIGS. 8A and 8B are views illustrating a roll gap deviation before and after roll gap control according to the other exemplary embodiment of the present disclosure.

In the current exemplary embodiment of the present disclosure, as shown in FIG. 5, the casting roll damage preventing apparatus for a twin roll strip casting machine may include the pair of first and second casting roll cylinders 32 and 34, first and second pressure detection units 21 and 22, first and second roll gap detection units 10 and 11, a roll gap deviation calculation unit 510, a low pass filter unit 520, and a control unit 530.

Hereinafter, the casting roll damage preventing apparatus will be described in detail with reference to FIGS. 5 to 8B according to the current exemplary embodiment of the present disclosure. The casting roll damage preventing apparatus of the current exemplary embodiment of the present disclosure may be mainly used for performing a roll gap deviation control operation (also referred to as "wedge control operation") in an early stage of casting while pressing casting rolls (by applying a force of at least 20 tons) according to a target pressure value for maintaining a set roll gap. However, the casting roll damage preventing apparatus is not limited thereto. For example, in the middle of casting, the casting roll damage preventing apparatus of the current exemplary embodiment may be used in combination with the casting roll damage preventing apparatus of the exemplary embodiment described in FIGS. 1 to 4.

Referring to FIG. 5, the pair of first and second casting roll cylinders 32 and 34 are arranged on the width of a driving roll 2 and are driven by cylinder driving units 31 and 33 to drive the driving roll 2 toward a fixed roll 1 (by applying a force of at least 20 tons) according to a target pressure value for maintaining a set roll gap.

In detail, the first casting roll cylinder 32 may be placed on one side of the an axis of the driving roll 2 to drive the driving roll toward the fixed roll 1, and the second casting roll cylinder 34 may be placed at the other side on the axis of the driving roll 2 to drive the driving roll 2 toward the fixed roll 1.

The (two) first and second pressure detection units 21 and 22 may respectively measure interior pressures of the pair of first and second casting roll cylinders 32 and 34, and the measured interior pressures may be delivered to a second error calculation unit 533 and a fourth error calculation unit 536 of the control unit 530. For example, the two pressure detection units 21 and 22 may be pressure sensors.

The first and second roll gap detection units 10 and 11 (two in number) may be disposed at an end side and the other end side of the driving and fixed rolls 2 and 1 so as to measure the roll gap between the driving and fixed rolls 2 and 1, and measured roll gaps may be delivered to the roll gap deviation calculation unit 510. For example, the first and second roll gap detection units 10 and 11 may be roll gap sensors such as linear variable differential transformers.

The roll gap deviation calculation unit 510 may use the measured roll gaps to calculate a roll gap deviation along axes of the driving and fixed rolls 2 and 1.

In detail, the roll gap deviation may be calculated by subtracting the roll gap measured by the second roll gap detection unit 11 (also referred to as "a driving-side roll gap" which is measured between the driving and fixed rolls 2 and 1 on one side of the axis of the driving roll 2 where the second casting roll cylinder 34 is disposed) from the roll gap measured by the first roll gap detection unit 10 (also referred to as "a fixed-side roll gap" which is measured between the driving and fixed rolls 2 and 1 on one side of the axis of the driving roll 2 where the first casting roll cylinder 32 is disposed). The roll gap deviation on the axes of the driving and fixed rolls 2 and 1 may be delivered to the low pass filter unit 520.

That is, the roll gap deviation calculated by the roll gap deviation calculation unit 510 may be low-pass-filtered through the low pass filter unit 520.

That is, as shown in FIG. 6, a roll gap deviation 601 obtained using the roll gap detection units 10 and 11 is largely varied with time, and if the roll gap between the driving and fixed rolls 2 and 1 (casting rolls) is controlled based on the roll gap deviation 601, sealing at edge dams may become unstable. Particularly, if foreign objects such as molten steel surface skulls are introduced between the casting rolls 1 and 2, surfaces of the casting rolls 1 and 2 may be damaged.

Therefore, according to the current exemplary embodiment of the present disclosure, the roll gap deviation 601 obtained using the roll gap detection units 10 and 11 is low-pass-filtered (a signal obtained by the low pass filtering is denoted by reference numeral 602) to decrease time-dependent variations and thus to improve sealing at the edge dams and reduce damage to the surfaces of the casting rolls 1 and 2 caused by foreign objects.

The control unit 530 may have a structure as shown in FIG. 5. Hereinafter, the structure of the control unit 530 will be described in detail.

Referring to FIG. 5, a roll gap deviation filtered by the low pass filter unit 520 may be delivered to a roll gap deviation compensation unit 531, and then the roll gap deviation compensation unit 531 may generate a roll gap deviation compensation signal. For example, the roll gap deviation compensation signal may be a value obtained by multiplying the low-pas-filtered roll gap deviation received from the low pass filter unit 520 by a constant. The roll gap deviation compensation signal may be delivered to a first error calculation unit 532 and a third error calculation unit 535.

The first error calculation unit 532 may generate a new target pressure value by adding the roll gap deviation compensation signal received from the roll gap deviation compensation unit 531 to a set target pressure value. The new target pressure value may be delivered to the second error calculation unit 533.

The second error calculation unit 533 may calculate a pressure error between the new target pressure value received from the first error calculation unit 532 and the interior pressure of the first casting roll cylinder 32 measured by the first pressure detection unit 21 and may deliver the calculated pressure error to a first casting roll cylinder control unit 534.

Then, the first casting roll cylinder control unit 534 may generate a control signal for controlling the first casting roll cylinder 32 based on the pressure error received from the second error calculation unit 533. The cylinder driving unit 31 may control the first casting roll cylinder 32 according to the control signal so as to drive the driving roll 2. For example, the first casting roll cylinder control unit 534 may be any one of a proportional (P) control unit, a proportional-derivative (PD) control unit, and a proportional-integral-derivative (PID) control unit.

Similarly, the third error calculation unit 535 may generate a new target pressure value by adding the roll gap deviation compensation signal received from the roll gap deviation compensation unit 531 to a set target pressure value. The new target pressure value may be delivered to the fourth error calculation unit 536.

The fourth error calculation unit 536 may calculate a pressure error between the new target pressure value received from the third error calculation unit 535 and the interior pressure of the second casting roll cylinder 34 measured by the second pressure detection unit 22 and may deliver the calculated pressure error to a second casting roll cylinder control unit 537.

Then, the second casting roll cylinder control unit 537 may generate a control signal for controlling the second casting roll cylinder 34 based on the pressure error received from the fourth error calculation unit 536. The cylinder driving unit 33 may control the second casting roll cylinder 34 according to the control signal so as to drive the driving roll 2. For example, the second casting roll cylinder control unit 537 may be any one of a proportional (P) control unit, a proportional-derivative (PD) control unit, and a proportional-integral-derivative (PID) control unit.

That is, according to the above-described configuration, a target pressure value is increased for a casting roll cylinder disposed on one side of the axes of the casting rolls 1 and 2 to which foreign objects are introduced, and a target pressure value is decreased for a casting roll cylinder disposed on one side of the axes of the casting rolls 1 and 2 to which foreign objects are not introduced. In addition, time-dependent variations are artificially decreased as described above. Therefore, sealing at the edge dams may be improved and damage to the surfaces of the casting rolls 1 and 2 caused by foreign objects may be decreased.

FIGS. 7A to 7F are views illustrating points in time for starting operations of the casting roll cylinders 32 and 34 in a twin roll strip casting process according to the other exemplary embodiment of the present disclosure.

Figure 7A:
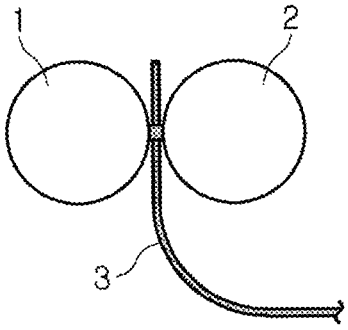
FIGS. 7A to 7F are views illustrating points in time for starting operation of casting roll cylinders in a twin roll strip casting process according to the other exemplary embodiment of the present disclosure.
Figure 7B:
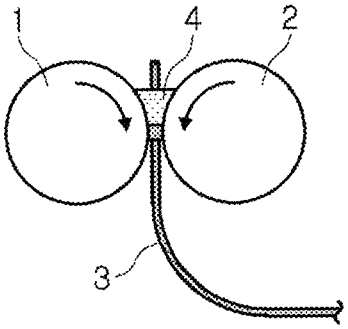
Figure 7C:
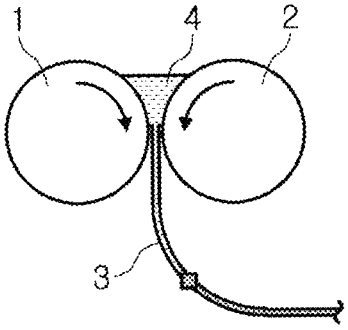
Figure 7D:
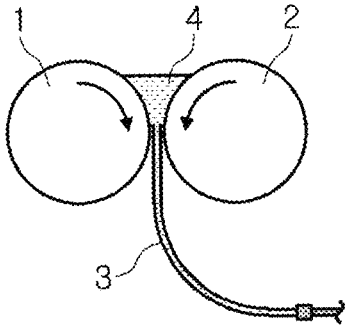
Figure 7E:
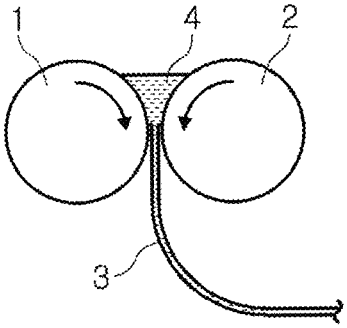
Figure 7F:
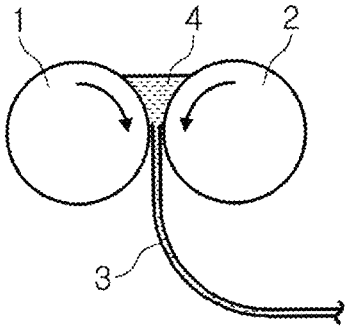
Figure 8A:
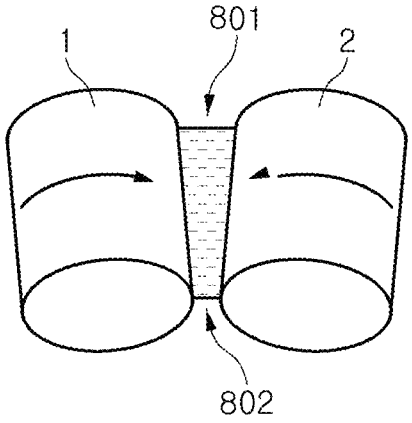
FIGS. 8A and 8B are views illustrating a roll gap deviation before and after roll gap control according to the other exemplary embodiment of the present disclosure.
Figure 8B:
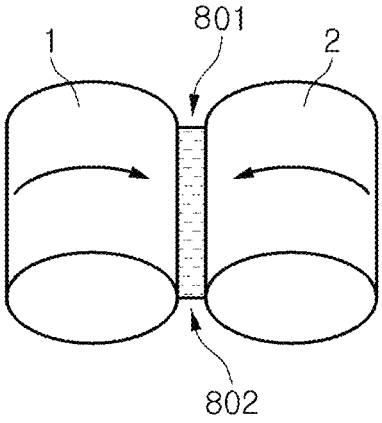

Referring to FIGS. 7A to 7F, a strip is produced as follows: a leader strip 3 is inserted between the two casting rolls 1 and 2 (please see FIG. 7A); molten steel 4 is attached to the leader strip 3 and solidified (as a strip); and the strip is drawn out of the two casting rolls 1 and 2 (please see FIG. 7B). Thereafter, the strip is continuously produced in the order shown in FIGS. 7C to 7F.

At this time, the casting roll cylinders 32 and 34 are operated in an early stage of casting so as to drive the casting rolls 1 and 2 by high pressure (for example, by applying a force of about 20 tons) and thus to stably attach molten steel 4 to the leader strip 3. That is, according to the exemplary embodiment of the present disclosure, when molten steel 4 solidified on the leader strip 3 is drawn out between the driving roll 2 and the fixed roll 1 as shown in FIG. 7B, the casting roll cylinders 32 and 34 are started to operate, and thus the molten steel 4 may be stably attached to the leader strip 3.

FIGS. 8A and 8B are views illustrating a roll gap deviation before and after roll gap control according to the other exemplary embodiment of the present disclosure.

Referring to FIG. 8A, before a roll gap control operation is performed according to the exemplary embodiment of the present disclosure, there is a roll gap deviation in the axial direction of the driving roll 2 because a roll gap 801 between the driving roll 2 and the fixed roll 1 measured at a side at which the first casting roll cylinder 32 is disposed is different from a roll gap 802 between the driving roll 2 and the fixed roll 1 measured at a side at which the second casting roll cylinder 34 is disposed.

However, as shown in FIG. 8B, after a roll gap control operation is performed according to the exemplary embodiment of the present disclosure, the roll gap deviation in the axial direction of the driving roll 2 is very low because the roll gap 801 between the driving roll 2 and the fixed roll 1 measured on the side on which the first casting roll cylinder 32 is disposed is similar to the roll gap 802 between the driving roll 2 and the fixed roll 1 measured on the side on which the second casting roll cylinder 34 is disposed.

As described above, according to the other exemplary embodiment of the present disclosure, a roll gap deviation measured using sensors is low-pass-filtered, and a new target pressure value obtained by adjusting a set target pressure value using the low-pass-filtered roll gap deviation is used for driving the driving roll (casting roll) 2. Therefore, sealing at the edge dams may be improved, and damage to the surfaces of the casting rolls 1 and 2 may be reduced.

Furthermore, according to the other embodiment of the present disclosure, the casting roll cylinders 32 and 34 are operated when molten steel solidified on a leader strip is drawn out from the driving roll 2 and the fixed roll 1, and thus molten steel may be stably attached to the leader strip in an early stage of casting.

Figure 9:
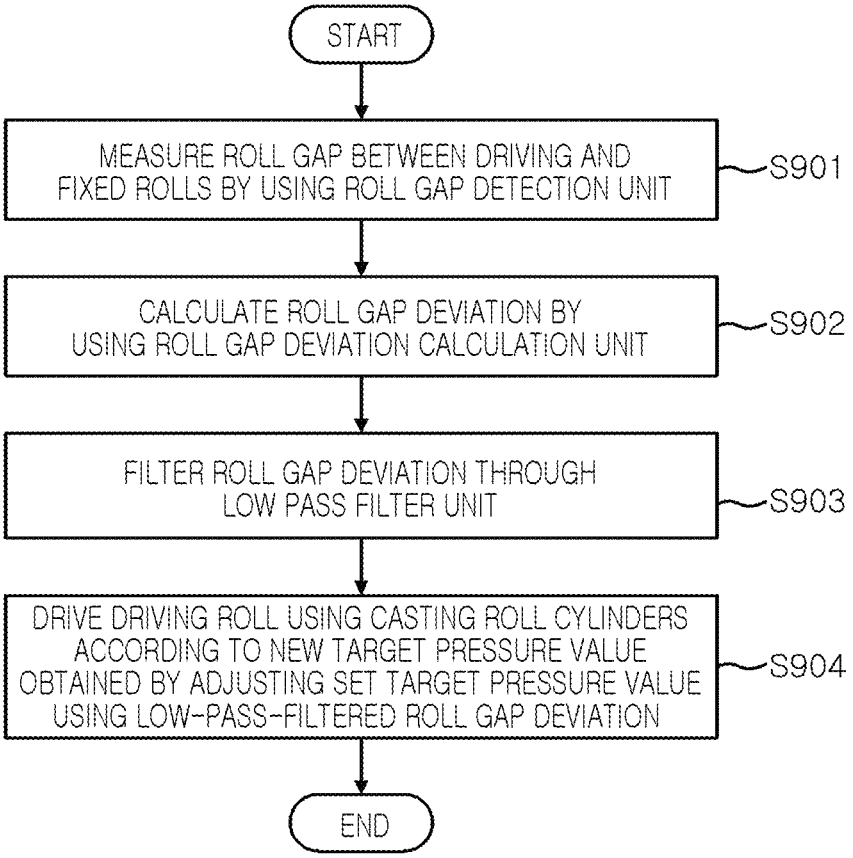
FIG. 9 is a flowchart illustrating a method for controlling casting roll cylinders in a twin roll strip casting process according to the other exemplary embodiment of the present disclosure.

FIG. 9 is a flowchart illustrating a method for controlling casting roll cylinders in a twin roll strip casting process according to the other exemplary embodiment of the present disclosure.

Hereinafter, the method for controlling casting roll cylinders in a twin roll strip casting process will be described in detail with reference to FIGS. 5 to 9. However, the same descriptions as those given above with reference to FIGS. 5 to 8 will not be repeated here for clarity.

First, the roll gap detection units 10 and 11 may measure a roll gap between the driving roll 2 and the fixed roll 1 (S901). The measured roll gap may be delivered to the roll gap deviation calculation unit 510.

Next, the roll gap deviation calculation unit 510 may calculate a roll gap deviation between the driving roll 2 and the fixed roll 1 (S902). The calculated roll gap deviation may be delivered to the low pass filter unit 520. Here, the roll gap deviation may be a value obtained by subtracting a roll gap value, measured between the driving roll 2 and the fixed roll 1 at a side at which the second casting roll cylinder 34 is disposed, from a roll gap value, measured between the driving roll 2 and the fixed roll 1 at a side at which the first casting roll cylinder 32 is disposed.

Next, the roll gap deviation calculated by the roll gap deviation calculation unit 510 may low-pass-filtered through the low pass filter unit 520 (S903).

Finally, the first and second casting roll cylinders 32 and 34 may drive the driving roll 2 according to a new target pressure value obtained by adjusting a set target pressure value using the low-pass-filtered roll gap deviation (S904).

As described above, according to the other exemplary embodiment of the present disclosure, a roll gap deviation measured using sensors is low-pass-filtered, and a new target pressure value obtained by adjusting a set target pressure value using the low-pass-filtered roll gap deviation is used for driving the driving roll (casting roll) 2. Therefore, sealing at the edge dams may be improved, and damage to the surfaces of the casting rolls 1 and 2 may be reduced.

Furthermore, according to the other embodiment of the present disclosure, the casting roll cylinders 32 and 34 are operated when molten steel solidified on a leader strip is drawn out from the driving roll 2 and the fixed roll 1, and thus molten steel may be stably attached to the leader strip in an early stage of casting.

As described above, according to the exemplary embodiments of the present disclosure, if foreign objects are introduced between the casting rolls while the roll gap of the casting rolls is controlled, a value obtained by adding a preset roll gap amount to a set roll gap instruction value is used to control the roll gap between the casting rolls. Therefore, the foreign objects may only be removed by a roll gap control operation without having to perform a roll pressing force control operation, and thus damage to the casting rolls may be prevented while reducing a period of time necessary for removing foreign objects and improving the process yield.

In the above descriptions of the exemplary embodiments of the present disclosure, the twin roll strip casting machine is exemplified. However, the twin roll strip casting machine is for helping understanding of the exemplary embodiments of the present disclosure. That is, other casting machines such as a belt type strip casting machine may be exemplified to describe exemplary embodiments of the present disclosure.

As set forth above, according to the exemplary embodiments of the present disclosure, if foreign objects are introduced, a value obtained by adding a preset roll gap amount to a set roll gap instruction value is used to control the roll gap between the casting rolls. Therefore, the foreign objects may be removed only by a roll gap control operation without having to perform a roll pressing force control operation, and thus damage to the casting rolls may be prevented while reducing a period of time necessary for removing foreign objects and improving the process yield.

In addition, according to the exemplary embodiments of the present disclosure, a roll gap deviation is low-pass-filtered, and a new target pressure value obtained by adjusting a set target pressure value using the low-pass-filtered roll gap deviation is used for controlling the roll gap deviation. Therefore, sealing at the edge dams may be improved, and damage to the surfaces of the casting rolls may be reduced.

While exemplary embodiments have been shown and described above, it will be apparent to those skilled in the art that modifications and variations could be made without departing from the scope of the present invention as defined by the appended claims.

What is claimed is:

1. An apparatus for preventing damage to casting rolls in a strip casting process in which the casting rolls are driven according to a target pressure value for maintaining a set roll gap, the apparatus comprising:

a roll pressing force detection unit measuring a roll pressing force applied to the casting rolls;

a foreign object determination unit determining whether foreign objects have been introduced to the casting rolls based on the measured roll pressing force;

a roll gap instruction value generation unit generating a roll gap instruction value by adding a preset roll gap amount to the set roll gap if it is determined that foreign objects have been introduced to the casting rolls; and a roll gap control unit controlling a roll gap between the casting rolls based on the roll gap instruction value.

2. The apparatus of claim 1, wherein the roll gap control unit controls the roll gap between the casting rolls based on the roll gap instruction value for a preset period of time, and after the preset period of time, the roll gap control unit controls the roll gap between the casting rolls based the set roll gap.

3. The apparatus of claim 1, wherein the preset roll gap amount is proportional to the measured roll pressing force.

4. The apparatus of claim 2, wherein the preset period of time is several seconds or shorter.

5. The apparatus of claim 1, further comprising:

a roll gap detection unit measuring a roll gap between a driving roll and a fixed roll constituting the casting rolls;

a roll gap deviation calculation unit calculating a roll gap deviation along axes of the driving roll and the fixed roll based on the measured roll gap;

a low pass filter unit through which the roll gap deviation is low-pass-filtered; and a pair of casting roll cylinders controlling the roll gap deviation according to a new target pressure value obtained by adjusting the target pressure value using the low-pass-filtered roll gap deviation.

6. The apparatus of claim 5, wherein the pair of casting roll cylinders comprise:

a first casting roll cylinder disposed on one side of the axis of the driving roll so as to drive the driving roll; and a second cast roll cylinder disposed on the other side of on the axis of the driving roll so as to drive the driving roll.

7. The apparatus of claim 6, wherein a target pressure value is increased for a casting roll cylinder disposed on one side of the axis of the driving roll to which foreign objects are introduced, and a target pressure value is decreased for a casting roll cylinder disposed on one side of the axis of the driving roll to which foreign objects are not introduced.

8. The apparatus of claim 6, wherein one of the pair of casting roll cylinders drives the driving roll according to a new target pressure value obtained by adding a value based on the low-pass-filtered roll gap deviation to the target pressure value, and the other of the pair of casting roll cylinders drives the driving roll according to a new target pressure value obtained by subtracting a value based on the low-pass-filtered roll gap deviation from the target pressure value.

9. The apparatus of claim 8, wherein the value based on the low-pass-filtered roll gap deviation is a value obtained by multiplying the low-pass-filtered roll gap deviation by a constant.

10. The apparatus of claim 6, wherein the roll gap deviation is a value obtained by subtracting a roll gap between the driving roll and the fixed roll measured on the side on which the second casting roll cylinder is disposed from a roll gap between the driving roll and the fixed roll measured on the side on which the first casting roll cylinder is disposed.

11. The apparatus of claim 5, wherein the pair of casting roll cylinders start to operate when molten steel solidified on a leader strip is drawn out between the casting rolls.

* * * * *

UNITED STATES PATENT AND TRADEMARK OFFICE

CERTIFICATE OF CORRECTION

PATENT NO. : 9,289,821 B2
APPLICATION NO. : 14/574673
DATED : March 22, 2016
INVENTOR(S) : Dae-Sung Lee et al.

It is certified that error appears in the above-identified patent and that said Letters Patent is hereby corrected as shown below:

Claims

Column 12, Line 2, Claim 2, delete "based" and insert -- based on --

Signed and Sealed this
Twenty-eighth Day of June, 2016

Michelle K. Lee

Michelle K. Lee
*Director of the United States Patent and Trademark Office*